United States Patent [19]

Bell

[11] 4,426,932

[45] Jan. 24, 1984

[54] CONTACT FUZE FOR MINE MUNITIONS

[75] Inventor: Frank H. Bell, Logan, Utah

[73] Assignee: Thiokol Corporation, Chicago, Ill.

[21] Appl. No.: 318,663

[22] Filed: Nov. 5, 1981

[51] Int. Cl.[3] ..... F42C 15/38

[52] U.S. Cl. ..... 102/221; 102/200; 102/481

[58] Field of Search ..... 102/315, 364–370, 102/401, 473, 477, 481, 200, 221, 705

[56] References Cited

U.S. PATENT DOCUMENTS

| | | | |
|---|---|---|---|
| 639,214 | 12/1899 | Coleman | 102/477 |
| 1,179,920 | 4/1916 | Hermanson | 102/477 |
| 3,667,388 | 6/1972 | Heinemann | 102/221 |
| 3,738,276 | 6/1973 | Picard et al. | 102/221 |
| 3,750,527 | 8/1973 | Heinemann | 102/401 |

FOREIGN PATENT DOCUMENTS

| | | | |
|---|---|---|---|
| 504857 | 4/1920 | France | 102/477 |

*Primary Examiner*—Charles T. Jordan
*Attorney, Agent, or Firm*—Gerald K. White

[57] ABSTRACT

An arming fuze for ordnance type munitions having but one movable part comprising a solvent desensitized liquid explosive contained in a ported (ventilated) cavity that is normally sealed by a sleeve. Upon movement of the sleeve and exposure of the liquid explosive within the cavity to the air, the liquid explosive loses a volatile solvent, the desenistizing agent, and becomes progressively more sensitive. A first embodiment is that of an inertia armed nose fuze for a projectile wherein the desensitized liquid explosive is enclosed in the cavity in a porous solid matrix. Upon rapid acceleration, as when the projectile is fired, the sleeve undergoes set-back thereby exposing the porous matrix to a violent slip stream of air and to a strong desiccating action. The liquid explosive rapidly loses solvent to the air, rapidly becoming more sensitive whereby it is impact sensitive by the time impact on the target occurs. A second embodiment is that of a contact fuze for mine munitions wherein the fuze is armed by manually moving the sleeve to uncover the ventilation ports thereby to allow the solvent to leave the explosive liquid. When the explosive liquid has "dried", it is rendered sensitive to pressure or shock whereby detonation occurs upon striking or crushing the fuze.

11 Claims, 2 Drawing Figures

CONTACT FUZE FOR MINE MUNITIONS

BACKGROUND OF THE INVENTION

1. Field of the Invention

The invention relates to an improvement in explosive devices or fuzes having utility in projectile and mine munitions and other classes of ordnance and which contain a pressure and/or shock sensitive primary explosive liquid that is desensitized with a volatile solvent for safe handling, transporation and storage.

2. Description of the Prior Art

Projectile, mine and other ordnance-type munitions have been widely used for centuries. The final functioning of the munition is controlled by an explosive device that is commonly termed a fuze. A fuze normally has elements to set off the munition, to prevent its premature functioning, and to cause it to function as desired only under predetermined conditions. These conditions determine the type of fuze that is needed, for example, an impact fuze or a contact fuze, a general requirement of fuzes for setting off munitions being, however, that they normally be inactivated or desensitized for safe handling, transportation and storage.

An impact fuze is one which functions as it hits the target. A particular requirement of this type of fuze, as applicable particularly to projectile munitions, is that it remain desensitized until seconds only or some other very short interval, before detonation; a concomitant requirement of the associated munition is that it be detonated in a relatively desensitized condition thereby to avoid detonation thereof as a result of being hurled or shot forward from a gun.

A contact fuze is one which functions when it is contacted, struck or crushed by another body. A requirement for this type of fuze, as applicable particularly to mine munitions, whether for use on land or sea, is that it remain desensitized for a predetermined delay period of substantial duration after being activated or armed. This is to allow sufficient time for safe departure from the scene of the parties placing and activating the mine.

In recent years the construction of these types of fuzes have become very complex, expensive and prone to corrosion. There thus exists a demand or a need for a very simple fuze, desirably one having a minimum of movable parts and no springs and which need not be made of metal.

For use with projectile munitions, there exists a need for such a simple fuze that will remain desensitized until a very short time, seconds or less only, before activation or arming. For use with mine munitions, there exists a need also for such a very simple delay arming fuze that need not be made of metal.

Liquid or chemical explosive devices requiring no moving parts have been proposed in the prior art. Such devices, however are maintained for safe handling, transportation and/or storage in a desensitized state by immersion in a specified volatile liquid. Upon removal from the volatile liquid and evaporation of absorbed volatile liquid from the device over a period of time, the device becomes armed. Such devices are disclosed in U.S. Pat. Nos. 3,667,388 and 3,750,527 to R. W. Heinemann. The need to immerse the device in a volatile fluid to make it safe for handling and storage renders the device undesirably complex and expensive as well as making it unsuitable for use in some applications such as projectile munitions applications.

In another form of chemical explosive device that has been proposed in the prior art, there is provided a compartmented cartridge having a different non-explosive liquid component in each compartment. Mixing of the different non-explosive components forms a liquid explosive material and arms the explosive device. U.S. patents disclosing such devices are U.S. Pat. Nos. 2,426,269 to N. M. Hopkins, 3,589,293 to E. Major, and 4,058,061 to D. L. Mansur et al. Such devices also are undesirably complex structurally and are also expensive because of the requirement for mixing of liquid components to arm the device.

While liquid explosive devices have been common in commercial and military applications for a great many years, there thus still exists a need for a simple liquid explosive device that remains desensitized until seconds before detonation, as well as a liquid explosive device that is intended to be detonated in a relatively desensitized condition.

SUMMARY OF THE INVENTION

An object of the invention is to provide a very simple arming fuze having but few component parts none of which need be made of metal.

Another object of the invention is to provide such a fuze that has a minimum of movable parts and no springs.

A further object of the invention is to provide a fuze that utilizes a liquid explosive which remains desensitized until seconds only before detonation.

An additional object of the invention is to provide a fuze that utilizes a liquid explosive that is intended to be detonated in a relatively desensitized condition.

A specific object of the invention is to provide a self-sparging armed nose impact fuze for projectiles.

Another specific object of the invention is to provide a very simple delay arming contact fuze for mine munitions.

In accomplishing these and other objectives of the invention there is provided, in a first embodiment, an inertia armed projectile nose fuze which contains desensitized liquid explosive, such as Nitroglycerine/solvent, enclosed in a forward cavity in a porous solid matrix. An aft cavity of the fuze contains an explosive booster charge. An external sealed sleeve encloses ventillating ports in the forward cavity. Upon rapid forward acceleration, as when propelled from a gun, the sleeve, because of its inertia, undergoes setback. That is, inertia causes the sleeve to move rearwardly of the fuze thereby to open the ports. As a result, the matrix is exposed through the ports to a violent slip stream of air which produces a forced, that is, a strong desiccating or sparging action, in effect a self-sparging action. That is to say, the solvent which is volatile is forcefully stripped from the desensitized liquid in the matrix whereby the liquid is quickly rendered sensitized. By the time projectile impact on the target occurs, the liquid explosive is impact sensitive. Target impact sets off the sensitized liquid explosive of the fuze, which, in turn, detonates the booster charge. The booster charge detonates a main explosive charge which may be a solvent desensitized liquid explosive if desired.

In a second embodiment of the invention, there is provided a contact fuze that has particular utility for mine munitions. This fuze comprises a capsule body containing a pressure and/or shock sensitive primary explosive liquid that also is desensitized with a volatile liquid or solvent. The fuze is armed by manually uncovering ventilation ports, as by removing a covering cap or sleeve, which removal, after a predetermined time, allows the volatile solvent to evaporate from the explosive liquid. When the explosive liquid has "dried", it is rendered sensitive to pressure or shock. Striking or crushing the capsule which holds the liquid primary explosive, as by a person walking or running on it, or contact by a moving vehicle, then detonates the liquid explosive. This shock detonates a booster charge that is contained within the capsule and then a main charge with which the fuze is associated and which it is intended to detonate.

There has further been provided in accordance with the second embodiment of the invention an explosive liquid that is desensitized by a solvent selected from the group consisting of hydrocarbons and halocarbons and which is filled with a rough, dense, mineral grit such as sand, ground glass and the like.

DESCRIPTION OF THE PREFERRED EMBODIMENTS

Figure 1:
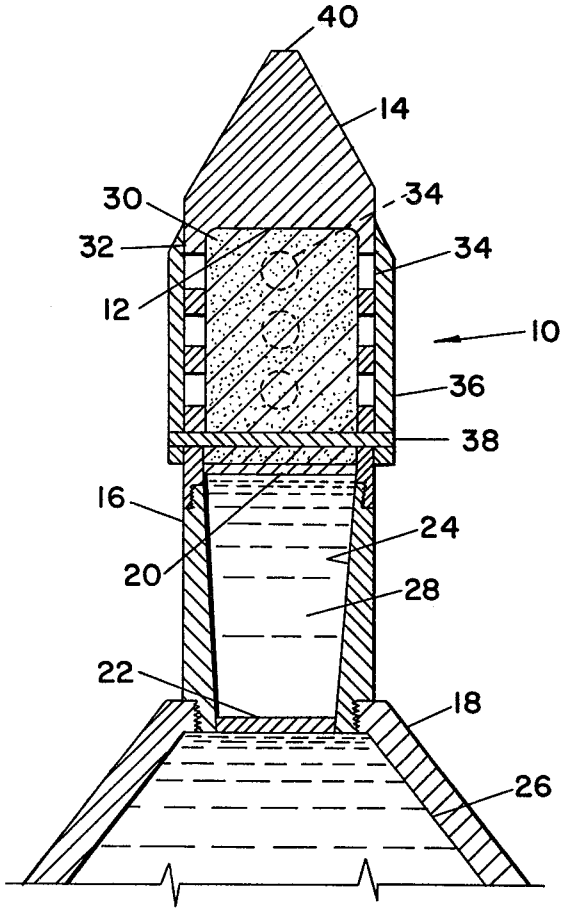
FIG. 1 is a longitudinal cross-sectional view of a self-sparging inertia armed nose fuze according to a first embodiment of the invention.

In FIG. 1 there is illustrated a first embodiment of the invention comprising an inertia armed nose fuze 10 for cannon or rocket projectiles or other warheads. The fuze 10 includes a forward cylindrical cavity 12 that is formed in a cylindrical housing that includes a nose cone 14. Cavity 12 and nose cone 14 are disposed forwardly of a cylindrical hollow nose shaft 16, being suitably attached thereto. The nose shaft 16, in turn, is suitably attached to the conical shoulder 18 of the shell of a projectile. The means by which nose cone 14 is attached to nose shaft 16, and the means by which shaft 16 is attached to shell shoulder 18, may comprise external threaded portions on each of the ends of the nose shaft 16 that mate with a respective internal threaded portion of the nose cone 14 and shell shoulder 18. It will be understood that, if desired, the nose cone 14, nose shaft 16, and shell shoulder 18 may be made integral with each other.

A metallic cavity partition 20 is provided at the aft end of cavity 12, and a similar metallic cavity partition 22 is provided at the aft end of nose shaft 16 whereby a rear shaft cylindrical cavity 24 is provided within the nose shaft 16. Cavity partition 22 seals off the interior of the shell shoulder 18 from the cavity 24.

Contained within shell shoulder 18 is a main explosive charge 26. Explosive charge 26 may be a liquid type, if desensitized, and has been so indicated in FIG. 1. Similarly contained within rear shaft cavity 24 is a booster charge 28. Booster charge 28 may also be a liquid type, if desensitized and has been so shown.

Forward cavity 12 of fuze 10 is filled with a desensitized liquid explosive fill 30 in a porous solid matrix. A desensitized liquid explosive that may be so employed is nitroglycerine containing an absorbed hydrocarbon or halocarbon solvent, for example, Acetone. Other liquid explosives and solvents that may be used are described hereinafter.

As shown, the wall 32 of nose cone 14 that forms cavity 12 is provided with a plurality of ventilation ports 34 that are distributed both circumferentially and longitudinally of the axis of the cylindrical forward cavity 12, twelve such ports being provided with four ports in each of three circumferential regions. It will be understood that additional or fewer ports may be employed as required by the conditions of use.

Enclosing the ports 34 is a cylindrical sealed nose sleeve 36 that normally is held against axial and rotational movement by a shear pin 38 that extends through the wall 32 of nose cone 14 and cavity 12.

The materials of which the nose cone 14, nose shaft 16, nose sleeve 36 and shear pin 38 are made may be metal or non-metal as conditions of the use of the fuze 10 dictate or indicate to be desirable, metal being indicated in the drawing for convenience of illustration. A suitable glass, plastic or ceramic material may also be employed for each of these component parts, if desired.

As shown, nose cone 14 is provided at its extreme forward end with a small flat portion 40 that is known to those skilled in the art of field artillery as a nose meplat. This small flat portion is introduced for stabilizing the bow or nose shock wave that occurs upon firing of the projectile.

The invention embodiment of FIG. 1, as noted, is of an inertia armed nose fuze for cannon or rocket projectiles. The inertia forces generated by launch acceleration shear the nose shear pin 38 due to the mass of the nose sleeve 36 and the tendency thereof, as a result, to be retarded in forward motion relatively to the nose cone 14. This causes the nose sleeve 36 to be moved rearward relatively to the nose cone 14, thereby uncovering the ventilation ports 34, thereby exposing the porous matrix 30 to a violent slip stream of air. The desensitized liquid explosive loses solvent to the air, thus becoming progressively more sensitive. By the time projectile impact on the target occurs, the liquid explosive is impact sensitive. Impact with the target detonates the impact sensitive liquid explosive, which, in turn, detonates the booster explosive charge 28. The booster charge 28 detonates the main explosive charge 26, which, as noted may be a solvent desensitized liquid explosive.

The effectiveness of this self-sparging inertia armed nose fuze may be varied depending upon the choice of liquid explosive for the matrix 30, the choice of the desensitizing solvent, the duration of projectile flight before target impact, the relative violence of the impact, the velocity range and velocity profile of flight, and the ratio of nose cavity port area to nose cavity volume, that is, the port area of exposure of the matrix 30 to the air to the volume of cavity 12.

It will be understood that the self-sparging inertia armed fuze of the present invention may be embodied in forms other than that illustrated and described in connection with FIG. 1. For example, instead of providing a shear pin 38 which when sheared allows the sleeve 36 to set back to uncover the ports 34 thereby to arm the fuze 10, the fuze 10 may be arranged to become armed as the result of "spin-up" of the sleeve 36. That is to say, the sleeve 36 may be provided with one or more cam slots (not shown) that are adapted to cooperate with a pin or pins that may be provided on the exterior of nose cone 14 whereby, upon launch of the projectile, the nose sleeve 36, due to its inertia and the rifling of the gun barrel may be caused to rotate relatively to the nose cone 14 and to be moved forwardly to uncover the ports 34. Alternatively, upon such rotation and forward movement, ports (not shown) that may be provided in the sleeve 36 and which normally are non-aligned with the ports 34 may be moved into alignment with the ports 34 to open them and to allow rapid evaporation of the solvent in the desensitized liquid 30.

It is noted that in actual field use a preferred embodiment of the fuze 10 illustrated in FIG. 1 could be protected by an open-nosed ballistic shield (not shown) with side vents which would pass air in the manner of an aircraft cowl.

Thus there has been provided, in accordance with the first embodiment of the invention, a fuze 10 which features the use of a liquid high explosive, which explosive has been desensitized with a suitable high vapor pressure solvent in a self-sparging configuation, to initiate detonation via impact with a target. As physically embodied, the fuze 10 has only one moving part, the sleeve 36, and no springs. The fuze 10 is characterized in that it is not armed until the equipped warhead has been launched on axis at high acceleration, that is, high "G-force". Further, the fuze 10 is not sensitive to impact detonation until it has been armed by set-back or spin-up and has "flown" in air for a sufficient time in an adequate velocity range for that flight time. The fuze 10, moreover, has a simple configuation for an impact fuze. Its manufacturing cost, produced in volume, should be relatively low. Additionally, it can be handled, transported and stored with a high degree of safety.

Figure 2:
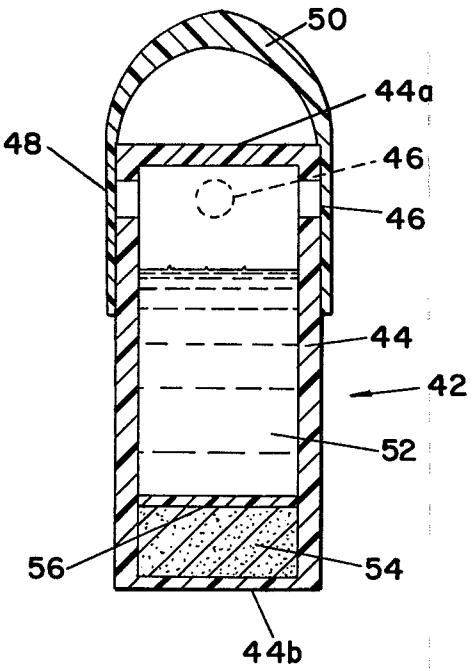
FIG. 2 is a longitudinal cross-sectional view of contact fuze for mine munitions according to a second embodiment of the invention.

In FIG. 2 there is illustrated a contact fuze indicated at 42 that has particular utility for mine munitions. Fuze 42 comprises a capsule body 44 which is made of a non-metallic material such as glass, plastic or ceramic. Capsule 44 has an upper end 44*a* and a lower end 44*b*. Ventillation ports 46 are provided in a circumferential region adjacent the upper end 44*a* of capsule 44, the ports 46 being covered and sealed by a removable sleeve 48. Sleeve 48 may be made of metal or plastic, and as illustrated, is in the form of a cap having a closed upper portion 50 whereby the entire upper portion 44*a* of the capsule body 44, and not only the ventilation ports 46, are covered by the sleeve 48. Desirably, the port cover sleeve 48 may be press fit or otherwise firmly attached as, for example, by latch means (not shown) to the capsule body 44 to guard against inadvertent removal of the sleeve 48 from the capsule body 44.

The cavity within capsule body 44 is filled to a level just below the ventillation ports 46 with a desensitized liquid primary high explosive indicated at 52 that is pressure and/or shock sensitive. The desensitizing agent may be an appropriate volatile hydrocarbon or halocarbon solvent such as Acetone. Nitroglycerine is an example of one liquid primary high explosive 52 that may be utilized in this embodiment of the invention. Other liquid explosives and solvents that may be employed are indicated hereafter. Desirably, for enhancing the sensitivity of the liquid explosive 52 after the solvent has evaporated, the liquid explosive 52 may be filled with a rough, dense mineral grit such as sand, ground glass and the like.

The fuze 42 is armed by manually uncovering the ventillation ports 46 by removing the removable sleeve 48. This allows the volatile solvent to evaporate whereby the desensitized liquid explosive 52 loses the solvent to the air. When the explosive liquid 52 has "dried", it is rendered sensitive to pressure or shock.

Also contained within the capsule body 44 adjacent the lower end 44*b* thereof is a booster solid explosive indicated at 54, which is separated along the longitudinal axis of the capsule body 44 from the explosive liquid 52 by a sealed barrier 56. Accordingly, striking or crushing the capsule body 44 which holds the liquid primary explosive 52 when the latter has been rendered sensitive to pressure or shock, as indicated above, detonates the booster charge 54. This, in turn, detonates a main explosive charge (not shown) but upon which the lower end 44*b* of the capsule body would be placed in mine munitions use.

Activation of the fuze 42 is a simple sequence. First, a mine is sited, that is, dug in or placed. Second, the fuze 42 is attached together with an integral booster charge 54 such as Tetryl. Third, with the fuze 42 upright the protective sleeve 48 is removed from the capsule body 44. Fourth, the desensitizing volatile solvent evaporates from the liquid primary high explosive 52 thereby progressively rendering the fuze 42 more sensitive to pressure or shock over a delay period. Fifth, the fuze 42 is ready to respond to pressure or shock. In the event that a stimulus is received by the fuze which has adequate energy density, the sensitized liquid explosive 52 detonates and communicates a shock wave first to the booster charge 54 and then to the main explosive charge.

There thus has been provided, in accordance with the second embodiment of the invention a fuze 42 that does not require any metal parts, nor any moving or movable parts other than the removable sleeve or cap. This embodiment of the invention further features an arming delay due to evaporation time of the volatile solvent from the desensitized liquid primary high explosive 52, which evaporation rate and time for full evaporation can be varied, if desired, by partial uncovering only the ventillation ports 46 by the removable sleeve 48. The fuze 42, moreover, may be made as insensitive as required by adjusting the percent of solvent used or changing the kind of solvent used. Further, the fuze 42 will have an indefinite shelf life as long as the percentage of volatile solvent does not change. It is noted, also, that in the event no metal parts are used to manufacture the fuze 42, it will not be detectable by a metal detector. A further characteristic feature of the fuze 42 is that it may be handled, transported and stored with a high degree of safety.

It is noted that liquid explosives other than Nitroglycerine that may be used for the liquid explosive 30 of the first embodiment, FIG. 1, of the invention and for the liquid explosive 52 of the second embodiment, FIG. 2, of the invention are:

A. Liquid hydrocarbons containing "nitrato" group(s), e.g.:

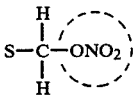

B. Liquid hydrocarbons containing "nitramine" groups, e.g.:

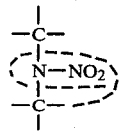

C. Liquid hydrocarbons containing "nitro" groups, e.g.:

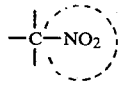

Specific examples of liquid hydrocarbons that may be employed for the liquid explosives 30 and 53 are:

a. Nitromethane, $CH_3NO_2$
b. Nitroglycerine, $C_3H_5N_3O_9$
c. Dinitroethane, $C_2H_4N_2O_4$
d. Dinitropropane, $C_3H_6N_2O_4$
e. Trinitropropane, $C_3H_5N_3O_6$
f. T.M.E.T.N. (Trimethylolethylenetrinitrate)
g. E.D.N.A. (Ethylenedinitramine)
h. General Form $C_AH_BN_CO_D$ Examples of liquid hydrocarbon and halocarbon solvents that may be employed for desensitizing the liquid explosives 30 and 52 are:

a. Acetone $CH_3COCH_3$
b. Freon 11, $CCl_3F$
c. Freon 12, $CCl_2F$
d. Freon 14, $CF_4$
e. Freon 114, $C_2Cl_2F_4$
f. Freon 318, $C_4H_8$
g. General Forms $C_AH_{2A}$,$C_ACl_BF_C$,$C_AF_C$ Thus, there has been provided in accordance with the invention a very simple arming fuze for ordnance type munitions having but one movable part and no springs, the single movable part being a sleeve that is moved to uncover ventilation ports that allow the evaporation of a solvent from a solvent desensitized liquid high explosive thereby to bring about sensitization of the liquid explosive and arming of the fuze.

In the first embodiment of the invention described, the fuze is not armed until it and a warhead on which it is mounted are launched on axis at high acceleration. In this fuze embodiment, the solvent is ripped forcefully from the liquid high explosive as by a self-sparging action caused by exposure of the ventilation ports to a violent slip stream of air whereby the liquid high explosive remains desensitized until only seconds or less before detonation of the fuze and warhead on target impact.

In the second embodiment of the invention described, the solvent evaporation occurs over a longer period of time that may be varied by partial uncovering of the ventilation ports thereby proving a time delay in the arming or an arming delay that is particularly desirable or necessary in mine munitions applications.

Both fuze embodiments of the invention feature the use of a liquid high explosive which has been desensitized with a high vapor pressure solvent and the use of ventillation ports which normally are covered and sealed by a movable sleeve and which may be moved to uncover the ventillation ports to allow evaporation of the solvent to render the liquid high explosive sensitive, and hence, to arm the fuze.

Subject matter disclosed but not claimed herein is disclosed in application Ser. No. 318,664, now U.S. Pat. No. 4,404,911 filed jointly by Frank H. Bell and John A. Peterson.

I claim:

1. An explosive device comprising a housing having an upper end and a lower end and having a cavity formed therein, said housing including adjacent its upper end a plurality of ventillation ports for the cavity, a movable sleeve normally covering and sealing said ventillation ports, and a desensitized liquid explosive filling said cavity to a level just below said ventillation ports, the desensitizing constituent of said desensitizing liquid explosive being a volatile solvent absorbed therein, whereby upon movement of said sleeve and uncovering of said ventillation ports said volatile solvent is allowed to evaporate and thus render said solvent desensitized liquid explosive sensitive, thereby arming said explosive device.

2. An explosive device as specified in claim 1 wherein said desensitized liquid explosive is filled with a rough, dense mineral grit such as sand, ground glass and the like for enhancing the sensitivity of said liquid explosive after said volatile solvent has evaporated.

3. An explosive device as specified in claim 1 wherein said housing and said sleeve are both formed of a non-metallic material.

4. An explosive device as specified in claim 3 wherein the non-metallic material is a plastic.

5. An explosive device as specified in claim 1 wherein said sleeve is formed in the shape of a cap and when in position to cover said ventillation ports also covers the entire upper end of said housing.

6. An explosive device as specified in claim 1 wherein said sleeve is adapted to be moved to only partially uncover said ventillation ports thereby to vary the rate of evaporation of said volatile solvent.

7. An explosive device as specified in claim 1 wherein said housing is cylindrical in form and is comprised of at least two segments that are separated along the longitudinal axis thereeof, the segment adjacent the upper end thereof including said ventilation ports and containing said desensitized liquid explosive, and the segment adjacent the lower end thereof containing a booster explosive charge, whereby when said housing is placed in an upright position with its lower end on a main explosive charge and said sleeve is moved to uncover said ventilation ports the resulting loss by evaporation of the volatile solvent from said desensitized liquid explosive renders the latter impact sensitive, such impact detonating the liquid explosive which, in turn, detonates the booster explosive charge, the booster explosive charge, in turn, being adapted to detonate the main explosive charge.

8. An explosive device as specified in claim 7 wherein said booster explosive charge is a solid explosive.

9. An explosive device as specified in claim 7 wherein said ventilation ports are disposed circumferentially around the segment that is adjacent the upper end of said housing.

10. An explosive device as specified in claim 1 wherein the desensitized liquid explosive is selected from the groups consisting of

| | |
|---|---|
| liquid hydrocarbons containing "nitrato" group(s), e.g. | 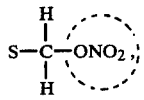 |
| liquid hydrocarbons containing "nitramine" groups | 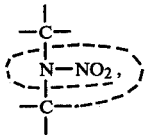 |

-continued

| | |
|---|---|
| liquid hydrocarbons containing "nitro" groups | 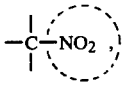 |

and admixtures thereof, and wherein the desensitizing constituent of said desensitized liquid explosive is a solvent selected from the group consisting of hydrocarbons, halocarbons and admixtures thereof.

11. An explosive device as specified in claim 10 wherein said desensitized liquid explosive is filled with a rough, dense mineral grit such as sand, ground glass and the like.

* * * * *